US005901588A

United States Patent [19]

Frost

[11] Patent Number: 5,901,588

[45] Date of Patent: May 11, 1999

[54] LOCKING APPARATUS FOR A SKATEBOARD

[76] Inventor: Thomas C. Frost, 526 S. Cedros Ave., Solana Beach, Calif. 92075

[21] Appl. No.: 09/030,585

[22] Filed: Feb. 25, 1998

[51] Int. Cl.[6] ..... E05B 9/04

[52] U.S. Cl. ..... 70/39; 70/18; 70/14; 70/58

[58] Field of Search ..... 70/14, 18, 19, 70/57, 58, 53, 233, 39, 26; 280/11.2, 11.15, 87.04 A, 87.05, 218.221

[56] References Cited

U.S. PATENT DOCUMENTS

| | | | |
|---|---|---|---|
| 660,307 | 10/1900 | Owen | 70/53 |
| 1,379,120 | 5/1921 | Miller | 70/39 |
| 1,666,453 | 4/1928 | Jakopets | 70/53 |
| 3,636,739 | 1/1972 | Smedley | 70/53 |
| 3,695,067 | 10/1972 | Bays | 70/63 |
| 4,085,600 | 4/1978 | Bindari | 70/53 |
| 4,155,231 | 5/1979 | Zane et al. | 70/18 |
| 4,545,224 | 10/1985 | Zane | 70/39 |
| 4,584,855 | 4/1986 | Burungame | 70/39 X |
| 4,773,239 | 9/1988 | Lowe et al. | 70/39 X |
| 4,896,519 | 1/1990 | Pitts | 70/18 X |
| 4,918,951 | 4/1990 | Kavizky | 70/39 X |
| 5,253,496 | 10/1993 | Wang | 70/53 X |
| 5,265,449 | 11/1993 | Rashleigh | 70/18 |
| 5,467,620 | 11/1995 | Byrd, Jr. | 70/38 |
| 5,505,064 | 4/1996 | Wang | 70/53 |
| 5,664,444 | 9/1997 | Schaan | 70/14 |
| 5,687,701 | 11/1997 | Henry | 70/18 X |
| 5,706,680 | 1/1998 | Wroble | 70/18 |

OTHER PUBLICATIONS

"Tamper–Pruf Screws" Catalog (no date), total pages—22.

*Primary Examiner*—Suzanne Dino Barrett
*Attorney, Agent, or Firm*—Kenyon S. Jenckes, Esq.

[57] ABSTRACT

A locking apparatus for locking a skateboard, snowboard, bicycle, or the like to a fixed object, such as a post or pole. The locking apparatus includes a "Y"- or "y"-shaped shackle with two legs, or an "E"-shaped shackle with three legs, each leg having a free end, and a locking cross bar with openings positioned to receive the free leg ends and a locking mechanism to lock the free leg ends of the shackle in the cross bar, thereby locking the locking apparatus. The shackle includes a first portion to receive the skateboard, snowboard, or bicycle, and a second portion to accommodate the fixed object. Security bolts are provided to secure the wheel trucks to the skateboard to prevent their removal while it is locker in the locking apparatus.

17 Claims, 3 Drawing Sheets

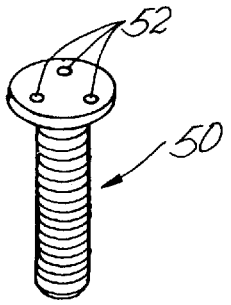
Fig. 4a
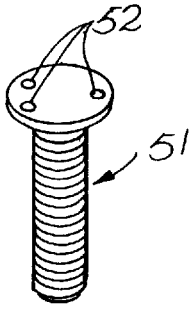
Fig. 4b
Fig. 5
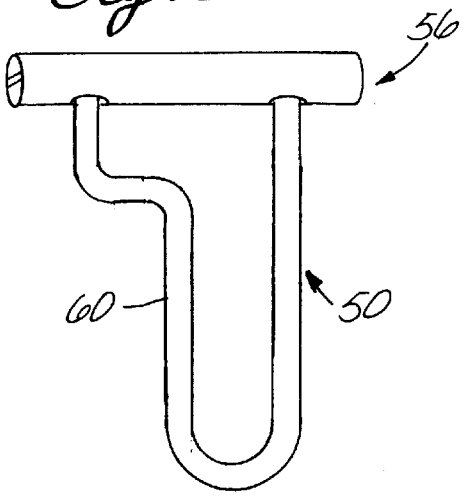
Fig. 2
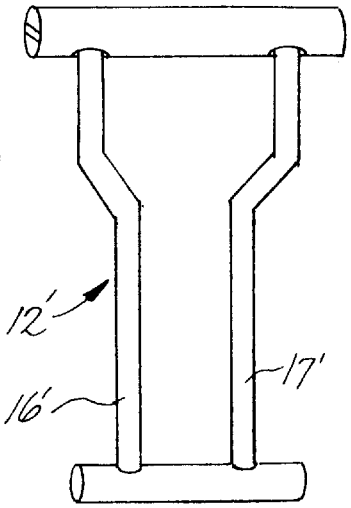
Fig. 6
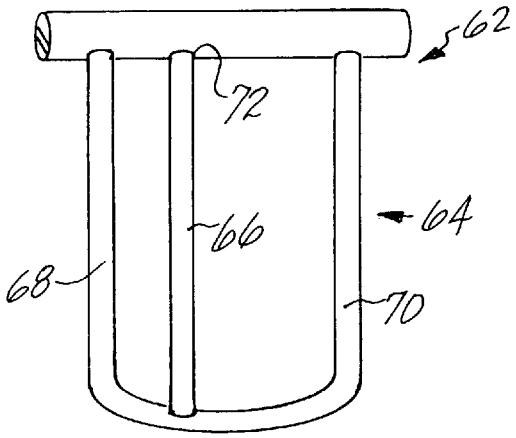

10
74
76

LOCKING APPARATUS FOR A SKATEBOARD

BACKGROUND OF THE INVENTION

The invention relates in general to locking devices, and in particular to a locking device adapted for locking any of a skateboard, a bicycle, a snowboard, or the like to a fixed object such as a post, pole, or tree.

Skateboards are popular for both transportation and recreation. Technological advances over the past several years have made skateboards more expensive. This, and the interchangeability of parts between different skateboards, make skateboards prone to theft, either as a whole or in parts.

Security devices for skateboards are virtually nonexistent. This is inconvenient for skateboarders because they must constantly carry or monitor their boards to avoid theft.

Locking devices such as chains and so-called "U-locks" commonly used for bicycle security are inadequate for use with skateboards. A loosely wrapped chain is sufficient for securing a bicycle since it can fit around both the frame of a bicycle and a fixed object such as a pole, tree, or bike rack. However, due to the relatively simple, unitary design of skateboards, which consist of a board and two wheel carrying wheel trucks mounted to the underside of the board, there is no comparable space through which to insert the chain. On the other hand, wrapping a chain tightly around the fixed object and the skateboard with sufficient tension to secure the skateboard could damage the board.

In recent years, U-shaped locks, or U-locks, have been developed to deter theft of bicycles, scooters, mopeds, motorcycles, etc. A U-lock is a locking device having a U-shaped shackle and a cross-bar. The U-shaped shackles includes a pair of ends which engage the cross-bar. One of the ends of the U-shaped shackle is typically disengageable from the cross-bar when the U-lock is unlocked to permit the other end of the shackle to pivot relative to the cross-bar in order to provide an opening to the U-shaped shackle such that the shackle may receive a portion of a bicycle frame and a stationary object such a bike rack.

The U-shaped shackle has two substantially parallel arms and a curved closed end. This shape maximizes the internal area of the shackle so that the frame tubes of two bicycles, or the frame tube and a tire of one bicycle, may fit in the same U-lock for improved security.

U-locks are inadequate to secure skateboards because the legs of the U-shaped shackle are too short to accommodate the width of the board and too wide to secure the combined thickness of the wheels and board.

For the foregoing reasons, there is a need for a locking device for securing skateboards.

SUMMARY

One embodiment of the invention is provided as follows: a locking apparatus, for locking a skateboard having a body to a fixed object, includes a shackle with two or more legs, each leg having a free end. A first portion of the locking apparatus, adapted to receive the skateboard body, is formed between two of the legs. The legs in the first portion are spaced apart a distance greater than the thickness of the skateboard body and less than four times the thickness of the skateboard body. A second portion, adapted to receive the fixed object to which the skateboard is to be locked, is formed between two of the legs, and the legs in the second portion are space apart a distance at least six times the thickness of the skateboard body. The locking apparatus also includes a cross piece comprising two or more openings, each adapted to receive a different one of the free leg ends, and a locking mechanism adjacent at least one of the openings for engaging the free end of an associated one of the legs.

According to alternate embodiments, the shackle has only two legs formed into either a capital "Y" shape or a lower case "y" shape. The first portion corresponds to a bottom, stem portion of the "Y" shape, and the second portion co-responds to a top portion of the "Y" shape and includes the free ends of the legs.

According to another embodiment, the shackle is a substantially U-shaped member including substantially parallel first and second legs and further includes a third leg positioned between, and substantially parallel to, the first and second legs to form an "E"-shaped shackle, wherein the first portion of the shackle is formed between the first leg and the third leg, and the second portion of the shackle is formed between the second and the third leg.

According to yet another embodiment of the invention, the locking apparatus is provided in combination with security bolts adapted for bolting the wheel trucks to the skateboard. Each security bolt has a head with one of several spanner hole arrangements drilled into it. Preferably Each security bolt includes three spanner holes.

BRIEF DESCRIPTION OF THE DRAWINGS

These and other features, aspects, and advantages of the present invention will become better understood with regard to the following description, appended claims, and accompanying drawings where;

FIG. 2 is another embodiment of a Y-lock according to the invention;

FIGS. 4*a* and 4*b* are perspective views of security bolts for use in combination with the Y-lock according to another embodiment of the invention;

FIG. 5 is another embodiment of a Y-lock according to the invention;

FIG. 6 is an E-shaped lock according to another embodiment of the invention.

DETAILED DESCRIPTION OF THE PREFERRED EMBODIMENTS

Figure 1:
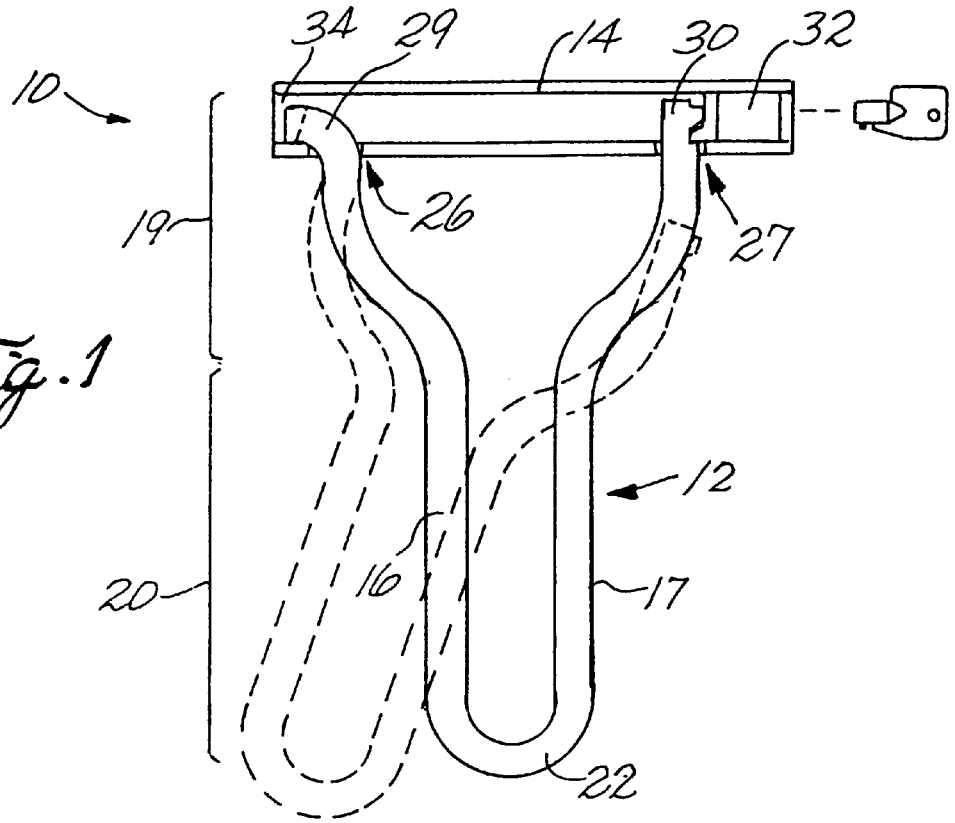
FIG. 1 is a perspective view of a Y-shaped lock (Y-lock) according to one embodiment of the invention.

Referring now to the drawings, FIG. 1 illustrates a Y-shaped lock 10 according to one embodiment of the invention which is particularly useful for securing a skateboard to a fixed object such as a post. The lock is comprised of two separable components, namely, a Y-shaped shackle 12 and a crosspiece to which the shackle may be locked.

Both the shackle 12 and the crosspiece 14 preferably are fabricated from a high grade steel and should be sufficiently thick to offer effective resistance to the action of a bolt cutter or to a hack saw. Preferably, the Y-shaped shackle is fabricated from solid cylindrical rod stock about ½" in diameter.

The Y-shaped shackle 12 is comprised of two legs 16, 17 and is formed into top 19 and bottom 20 portions. At the top portion of the shackle, corresponding to the top portion of a capital letter "Y", the legs have ends spaced apart approximately 4½ to 5½ inches. This top portion 19 is 3½ to 4½ inches long. Both legs 16, 17 then bend in and narrow, terminating in the lower portion 20 of the shackle, which corresponds to the stem of the capital letter "Y". In the lower portion, the legs are substantially parallel and spaced apart 1½ to 3½ inches, sufficient to accommodate the thickness of a skateboard. The gap formed between the legs in the lower portion 20 is approximately 9 to 12 inches long, sufficient to accommodate the width of a range of skateboard bodies.

Preferably the Y-shaped shackle 12 is formed from a single steel rod and is bent 180° at its lower most end 22 between the two legs.

Alternatively, as shown in FIG. 2, the Y-shaped shackle 10' may consist of two separate legs 16', 17' joined at the bottom end by a cross bar 24 to which they are permanently affixed.

Referring again to FIG. 1, the crosspiece 14 of the illustrated embodiment is of tubular construction and again preferably fabricated from a high quality hardened steel. Preferably, the crosspiece is cylindrical, having a diameter greater than the diameter of the rod stock used in making the shackle 12, with an outer diameter of approximately 1" and a length of approximately 7 to 8 inches. The crosspiece 14 includes a pair of openings 26, 27 to accept the ends 29, 30 of the legs. The crosspiece is disengageable from the Y-shaped shackle upon releasing a locking mechanism 32. One or both of the leg ends are adapted to engage the locking mechanism. According to the illustrated embodiment, one opening 27 in the crosspiece is adjacent the locking mechanism 32 and the other opening 26 is adjacent an opposite end of the crosspiece. Correspondingly, one leg end 30 is adapted for engaging the locking mechanism, and the other leg end 29 is bent to form a foot which fits into a recess 34 between tie opening and the crosspiece end. Several locking arrangements, including locking mechanisms and leg end designs, are known for U-locks and do not form a part of the present invention.

According to a preferred embodiment, the Y-shaped shackle 12 is connected to the crosspiece by first placing the locking mechanism 32 in an open, or unlocked position. The bent foot end 29 of leg 16 is then inserted in the recess 34 adjacent crosspiece opening 26, as suggested in dotted line in FIG. 1, by tilting the shackle with respect to the crosspiece 14. When the bent foot end 29 is within the crosspiece, the shackle is then tilted to bring the other shackle leg end 30 into crosspiece opening 27, as shown in full line in FIG. 1. The locking mechanism is then placed in a locking position by turning the associated key 36. The reverse procedure is employed when engaging the crosspiece from the shackle.

Figure 3:
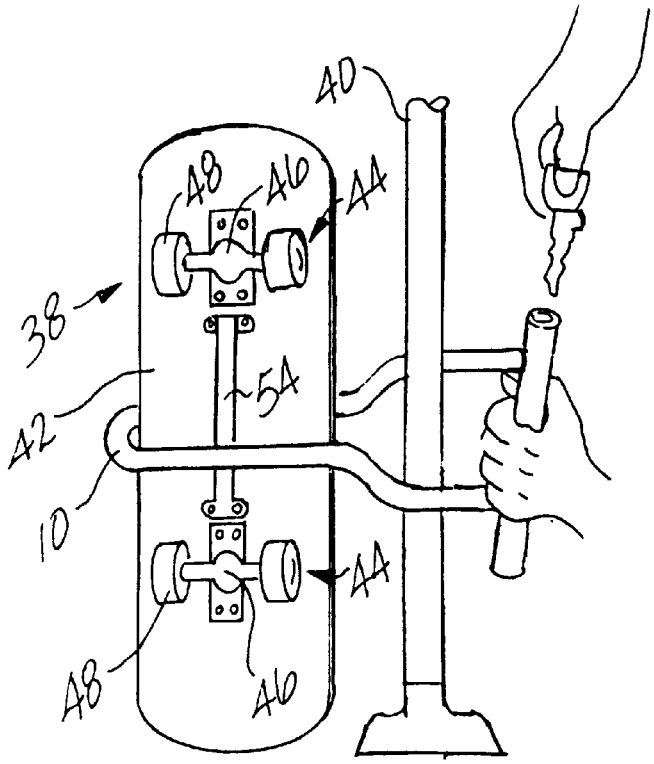
FIG. 3 is a perspective view illustrating use of the Y-lock to secure a skateboard to a fixed object.

The Y-shaped lock is particularly useful in securing a skateboard 38 to a fixed object 40, such as a pole, sign post, parking meter or the like, as shown in FIG. 3. Skateboards have a relatively simple, unitary construction comprising a body 42 and two wheel assemblies 44. Skateboard bodies have thicknesses ranging from about ½ to 1½ inches, lengths ranging from about 2 to 4½ feet, and widths ranging from about 6 to 16 inches. The wheel assemblies are mounted towards either end of the skateboard body on the underside of the body. Each wheel assembly comprises a wheel truck 46 with two bearing mounted wheels 48 on either side. Each wheel truck is bolted or otherwise fixed to the bottom of the board body.

To lock the skateboard to a fixed object, e.g., a sign post, the shackle 12 is disengaged from the crosspiece 14. The middle portion of the skateboard body, between the two wheel assemblies, is fit between the gap between the legs in the bottom portion 20 of the shackle. The top portion 19 of the legs are positioned around the post 40. With the skateboard in the rear portion 20 of the shackle and the post in the front portion 19, the ends of the legs are engaged in the openings of the crosspiece 14 and locked, thereby securing the skateboard to the post. As mentioned above, the gap between the legs in the bottom portion of the shackle is about 1½ to 3½ inches wide, whereas the distance between the top of the skateboard body 42 and bottom of the wheel trucks 46 is typically 3¾ inches or greater. Accordingly, the skateboard cannot be slipped out from the gap between the legs in the lower portion 20 as it is impeded by the wheels and/or wheel trucks. Further, with the post 40 occupying the top portion 19 of the lock, the skateboard is blocked from being slid into, and removed from the wider top portion 19.

According to another embodiment, security bolts are provided with the Y-lock for mounting the wheel trucks. This combination prevents theft due to removal of the wheel trucks from the skateboard while secured in the Y-lock embodiment described above. As shown in FIGS. 4*a* and 4*b*, the bolts according to one embodiment are spanner-type, pan head bolts 50, 51 with drilled spanner holes 52 arranged in different patterns in the heads of the bolts. The bolts are adjusted using an associated spanner tool (not shown) that has prongs corresponding to each of these spanner holes 52. Preferably, three or more spanner holes are provided in the bolt heads. The pattern of the holes is preferably balanced to improve turning of the spanner tool while adjusting the bolts without slipping. According to this embodiment, each Y-lock is provided in combination with a set of such security bolts having one of several different spanner hole patterns in order to decrease the possibility of theft. Thus, the security bolts provided with one Y-lock will all have the same spanner hole pattern, but this pattern may differ from that of a set of security bolts associated with a different Y-lock. The spanner hole patterns may be varied, for example, by changing the radii of the spanner holes 52 on the bolt head, the distance between the spanner holes, and the thickness of the holes. Other types of security bolts, and corresponding driver/removal tools, may be used according to alternate embodiments of the invention. For example, notched head spanner bolts, bolts with "one way" -type heads, and bolts having tamper-resistant hex and star-shaped sockets may be used according to the invention.

Further, an anti-saw bar 54 may be provided on the underside of the skateboard body, between the wheel trucks, to prevent the skateboard from being sawed in half in order to remove it from the Y-lock (see FIG. 3). Preferably, the anti-saw bar is also mounted to the skateboard body using the security bolts.

FIG. 5 illustrates a y-lock 56 similar to the Y-lock 10 illustrated in FIG. 1, however, the y-shaped shackle 58 has the shape of a lower case "y" rather than a capital "Y". Again the y-lock has 4½ to 5½ inches spacing between the legs in the top portion and 1½ to 3½ inches between the legs in the bottom portion, however only one leg 60 is curved.

FIG. 6 illustrates an E-shaped lock 62, or E-lock. The E-lock includes a substantially U-shaped shackle 64 with a third leg 66 parallel to a first leg 68 and a second leg 70. The third leg 66 is permanently connected at one end to the lower end of the "U" and has a free end (hidden) to be inserted into an associated extra hole 72 in the crosspiece. The third leg 66 is 1½ to 3½ inches from the first leg 68 and 4½ to 5½ inches from the second leg 70. According to this embodiment, the skateboard is inserted between the first leg 68 and the third leg 66, and the pole, or other fixed object, is inserted in the space between the third leg 66 and the second leg 70.

Figure 7:
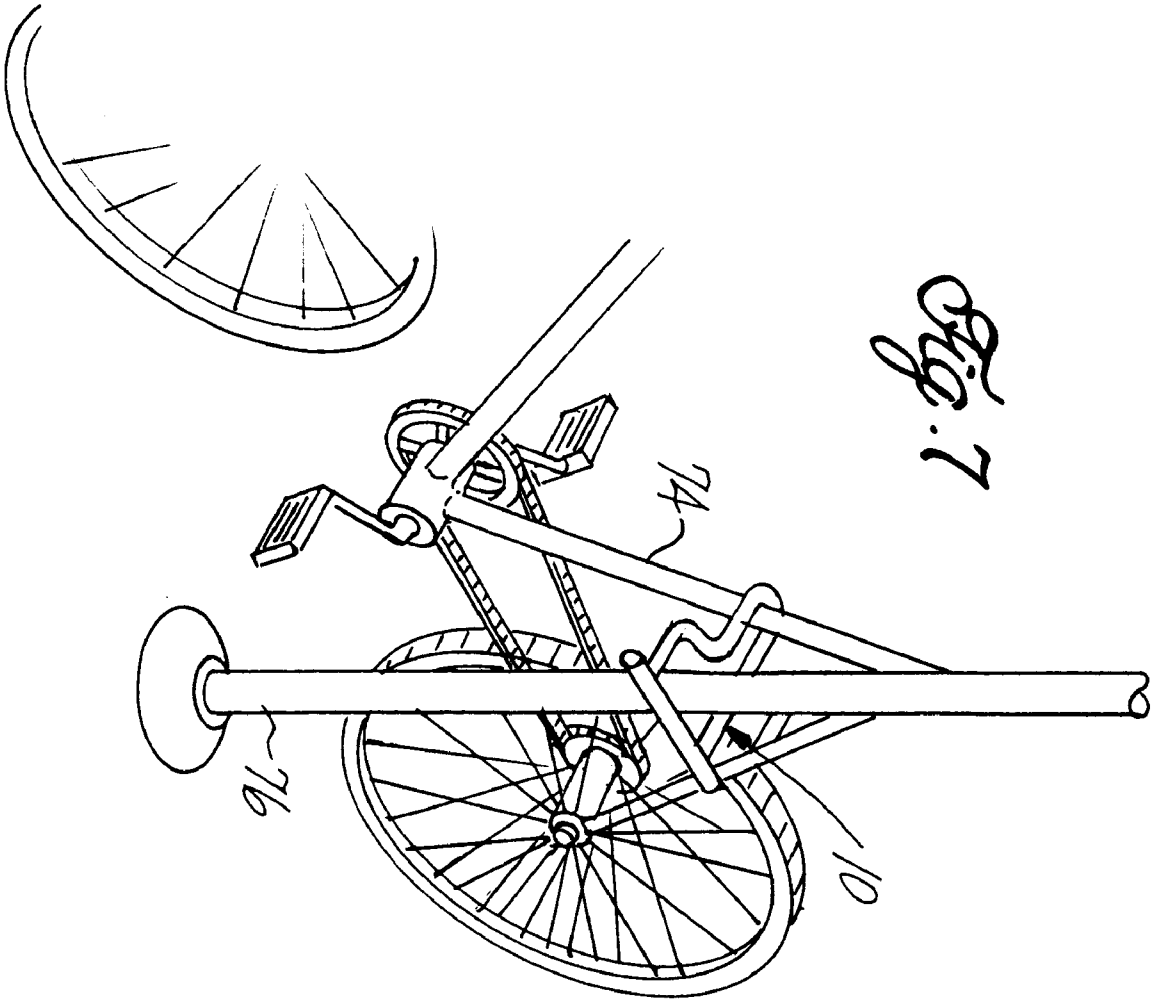
FIG. 7 is a perspective view illustrating use of the Y-lock according to the invention to secure a bicycle to a fixed object.

As shown in FIG. 7, a Y-shaped lock 56 according to the invention may also be used to secure a bicycle 74. To secure the bicycle, one of the bicycle frame tubes is inserted between the gap between the legs in the bottom portion of the Y-shaped lock and the fixed object 76 is positioned between the legs in the top part of the y-shaped lock.

According to the above-described Embodiments of the invention, it is possible to secure any ones of a skateboard, a snowboard, a bicycle or the like to an anchored object. A sturdy locking device having dimensions specifically suited to accommodate a skateboard and a fixed object in such a manner as to prevent withdrawal of the skateboard from the device is provided. Further, additional security measures which supplement the locking device are provided according to alternate embodiments.

Although the present invention has been described in considerable detail with reference to certain preferred embodiments thereof, other embodiments are possible. Therefore, the spirit and scope of the appended claims should not be limited to the description of the preferred versions contained herein.

I claim:

1. A locking apparatus for use with a skateboard having a body with a thickness and a width, the locking apparatus comprising:

a shackle having a length and comprising, a plurality of legs, each having a free end, a first portion having a length, formed between two of the plurality of legs, the legs in the first portion being spaced apart a distance greater than the thickness of such skateboard body and less than four times the thickness of such skateboard body, a second portion, having a length, formed between two of the plurality of legs, the legs in the second portion being spaced apart a distance at least six times the thickness of such skateboard body, wherein the length of the shackle is greater than the width of the skateboard, and the length of the first portion is greater than the length of the second portion, and a cross piece comprising, a plurality of openings, each adapted to receive a different one of the plurality of free leg ends, and a locking mechanism adjacent at least one of the plurality of openings for engaging an associated one of said plurality of free leg ends.

2. The locking apparatus of claim 1, wherein the shackle comprises two legs bent to form a capital "Y" shape, wherein the first portion comprises a bottom, stem portion of the "Y" shape, and wherein the second portion comprises a top portion of the "Y" shape and includes the free ends of the two legs.

3. The locking apparatus of claim 1, wherein the shackle comprises two legs, one of which is bent to form a lower case "y" shape, wherein the first portion comprises a bottom, stem portion of the "y" shape, and wherein the second portion comprises a top portion of the "y" shape and includes the free ends of the two legs.

4. The locking apparatus of claim 1, wherein such skateboard includes a plurality of wheel trucks bolted to the body, the locking apparatus further comprising, in combination, a plurality of security bolts adapted for bolting the wheel trucks to the skateboard body, each security bolt comprising a head having one of a plurality of spanner hole arrangements.

5. The locking apparatus of claim 4, wherein each security bolt head comprises at least three spanner holes.

6. The locking apparatus of claim 4, further comprising an anti-saw bar to be bolted with the security bolts to an underside of such skateboard between the wheel trucks.

7. A lock of a skateboard having a thickness and a width, the lock comprising:

a shackle having a length and comprising, two spaced apart legs, a rear portion, having a length and a closed end, in which the legs are substantially parallel and spaced apart a distance less than four times the thickness of such skateboard, a front portion having a length and including a free end of each leg and in which the legs are substantially parallel and spaced apart a distance at least six times the thickness of the skateboard, wherein the length of the shackle is greater than the width of the skateboard, and the length of the rear portion is greater than the length of the front portion, a cross piece comprising, two openings, each adapted to receive one of the free ends of the legs, and a locking mechanism associated with at least one of the openings for engaging an associated one of the free leg ends.

8. The lock of claim 7, wherein the legs form a capital "Y" shape.

9. The lock of claim 7, wherein the legs form a lower case "y" shape.

10. The lock of claim 7, wherein the shackle is formed from hardened steel rod stock.

11. The lock of claim 7, wherein the cross piece is a cylindrical steel piece.

12. A Y-shaped lock comprising:

a Y-shaped shackle having a length and comprising two spaced apart legs and formed into, an upper portion having a length and comprising a free end of each leg, in which the legs are spaced apart a distance in a range of from 4½ inches to 5½ inches, and a lower portion having a length and closed at one end, in which the legs are space apart a distance in a range from 1½ inches to 3½ inches, wherein the length of the lower portion is greater than the length of the upper portion; and a locking cross bar comprising:

two openings, each opening adapted to receive a different one of the free leg ends, and a locking mechanism adjacent at least one of the openings for engaging an associated one of the free leg ends.

13. The Y-shaped lock of claim 12, further comprising a middle portion between the upper and lower portions in which at least one of the legs bends towards the other, thereby narrowing the gap between the legs.

14. The Y-shaped lock of claim 13, wherein one leg bends toward the other leg to form a lower case "y" shape.

15. The Y-shaped lock of claim 13, wherein each of the legs bends toward the other leg to form a capital "Y" shape.

16. The Y-shaped lock of claim 12, wherein the lower portion of the shackle has a length in a range for from 9 inches to 12 inches.

17. A locking apparatus for use with a skateboard having a body with a thickness, the locking apparatus comprising:

an "E" shaped shackle comprising a substantially U-shaped member including substantially parallel first and second legs and a third leg positioned between, and substantially parallel to, both the first and second legs, each of said legs having a free end, a first portion formed between the first leg and the third leg, said first and third legs being spaced apart a distance greater than the thickness of the skateboard body and less than four times the thickness of the skateboard body, a second portion formed between the second leg and the third leg, said second and third legs being spaced apart a distance at least six times the thickness of the skateboard body; and a cross piece comprising, a plurality of openings, each adapted to receive a different one of the plurality of free leg ends, and a locking mechanism adjacent at least one of the plurality of openings for engaging an associated one of said plurality of free leg ends.

* * * * *

UNITED STATES PATENT AND TRADEMARK OFFICE

CERTIFICATE OF CORRECTION

PATENT NO. : 5,901,588

DATED : May 11, 1999

INVENTOR(S) : Thomas C. Frost

It is certified that error appears in the above-identified patent and that said Letters Patent is hereby corrected as shown below:

In the drawings, Sheet 2, Fig. 2, the reference numeral 10 and an associated arrow should be applied to the entire lock, and the reference numeral 24 should be applied to the lower horizontal cross bar; and Sheet 2, Fig. 5, the reference numeral "50" should be deleted and replaced with - - 58 - -.

Signed and Sealed this

First Day of August, 2000

*Attest:*

*Attesting Officer*

Q. TODD DICKINSON

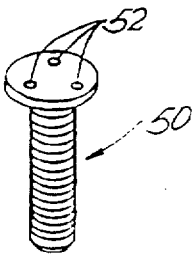
Fig. 4a
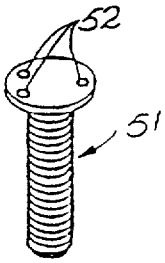
Fig. 4b
Fig. 5
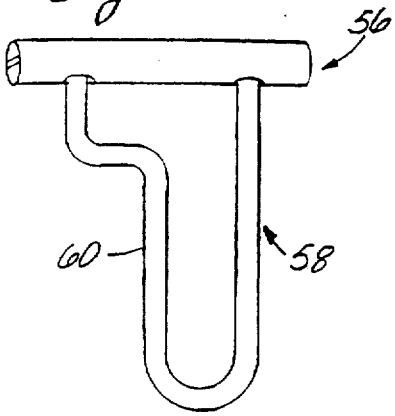
Fig. 2
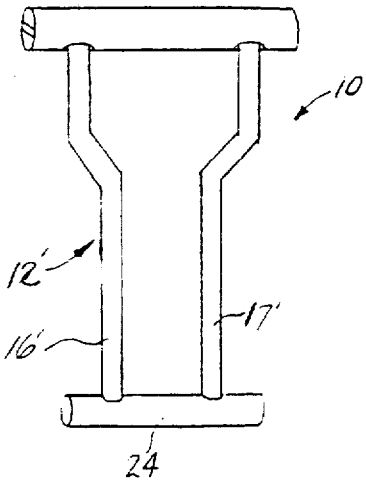
Fig. 6
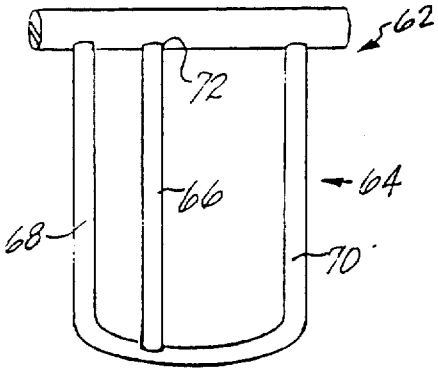

*Director of Patents and Trademarks*